United States Patent [19]

Bonnaval

[11] 3,978,485

[45] Aug. 31, 1976

[54] DIRECTIONAL SLOT ANTENNA FOR VERY HIGH FREQUENCIES

[75] Inventor: Pierre Bonnaval, Paris, France

[73] Assignee: Telecommunications Radioelectriques et Telephoniques T.R.T., Paris, France

[22] Filed: May 25, 1965

[21] Appl. No.: 458,787

[52] U.S. Cl. ..... 343/767; 343/771

[51] Int. Cl.[2] ..... H01Q 13/10

[58] Field of Search ..... 343/767–771

[56] References Cited

UNITED STATES PATENTS 3,530,479 9/1970 Waldron ..... 343/767 X

*Primary Examiner*—T.H. Tubbesing

*Attorney, Agent, or Firm*—Stevens, Davis, Miller & Mosher

[57] ABSTRACT

The subject matter of this application concerns directional slot antenna suitable for very high frequencies. The antenna is made up from a wave guide closed at one end on a terminal absorption load. One face of the wave guide is characterized by an elongated slot of consistent width which is formed in relation to the remainder of the wave guide according to a prescribed mathematical relationship.

3 Claims, 9 Drawing Figures

DIRECTIONAL SLOT ANTENNA FOR VERY HIGH FREQUENCIES

The present invention relates to an antenna for very high frequencies, made up of a segment of wave guide closed on a terminal (stub) absorption load, and presenting in one of its walls a longitudinal slit of constant width, which will be called a slot in the following description.

It is not possible to obtain, from a rectilinear slot in a prismatic guide, a flat-top radiation pattern in the shape of a half cone, without getting spurious secondary lobes in said pattern, and, until now, nobody knew how to shape slot antennas so as to eliminate these secondary lobes without impairing the symmetry of said pattern.

In the invention the wave guide is so designed that opposite variations take place along the wave guide, of the distances to the slot of each of the walls adjoining to the wall where said slot is provided.

One object of the invention is to obtain, (with a good efficiency) by the use of this type of antenna, with power supplied according to the fundamental $TE_{10}$ mode, a radiation pattern having the shape of a half cone of revolution accompanied by secondary lobes of little importance in the meridian diagram.

Another object of the invention is to obtain, by employing two such antennas properly associated, a radiation pattern having the shape of a cone of revolution with the advantages mentioned above.

Still another object of the invention is to obtain a transversal diagram for the radiation of the symmetrical antenna.

Still another object is to obtain a meridian diagram radiation antenna having a shape adapted to the needs.

The characteristics, objects, and advantages of the invention will be better explained and understood with the help of the annexed drawings given by way of non limitative examples, among which:

FIG. 1 shows in perspective a rectangular guide with a slot, forming an antenna in accordance with this invention;

FIGS. 1*a* and 1*b* show respectively the shape of the conical flat/top pattern of radiation and its meridian cross section;

According to the invention supposing that the slot wave guide, used as an antenna, is of a constant rectangular section, the shape of the lateral walls of this antenna, adjacent to the wall where the slot is, is calculated admitting that the energetic coupling (A) of the space outside the guide at a point of the slot which is equal to the ratio of the radiant energy in this point to the energy carried by the guide across the corresponding section of the guide, is for the given guide, proportional to the square of the sine function $x/a$, where $x$ is the distance from this point of the slot to the middle of the adjacent walls (distance measured transversaly to the slot) and $a$ the inside width of the guide.

More precisely, if Z is the abscissa of a given point of the slot of length L, i.e. the distance of this point to the end of this slot, situated on the side of the power feed:

$$A = K^2 \operatorname{Sin}^2 \pi \frac{x}{a}$$

with $$K^2 = \frac{2d}{b} \frac{\lambda \lambda_g L}{\lambda_c^3},$$

and the following notations:

- $d$ for the width of the slot
- $b$ for the inside height of the guide section for the free space length of the waves which have to be transmitted.
- $g$ for the phase-modulated wave length in the section of the guide transmitting the waves which have to be transmitted in the fundamental mode.
- $c$ for the cut-off wave length of said guide section in the fundamental mode ($c = 2a$)

This can be written in the following general equation:

$$x = \frac{a}{\pi} \operatorname{arc\,sin} \sqrt{\frac{b}{2d} \frac{\lambda_c^3}{\lambda \lambda_g L} \cdot \frac{P \frac{(Z)}{L}}{1 - \int_0^{\frac{Z}{L}} P(y)\, dy}}$$

in which:

P (Z/L) is the relative energetic illumination which has to be obtained at the various points of the aforesaid slot, said illumination being a function of the distance Z divided by the length L, and;

- $y$ a purely mathematical variable permitting of carrying out the integration.

This equation becomes, in a practical case, a function of the form:

$$x = \frac{a}{\pi} \operatorname{arc\,sin} \frac{\alpha \operatorname{Sin}^2 \pi \frac{Z}{L}}{\sqrt{1 - \beta \frac{Z}{L} + \gamma (\operatorname{Sin}^2 \frac{\pi 2}{L} + \delta) \operatorname{Sin} \frac{2\pi Z}{L}}}$$

with for example:

$\alpha = 0{,}121$ approx.
$\beta = 0{,}95$ approx.
$\gamma = 0{,}1$ approx.
$\delta = 1{,}5$ approx.

Figure 1:
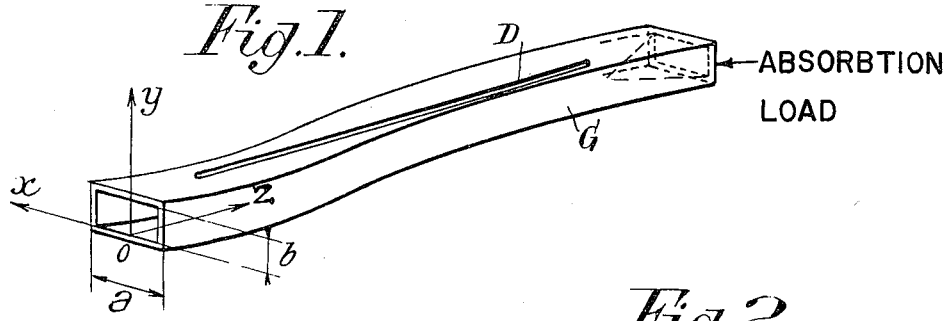
Figure 1A:
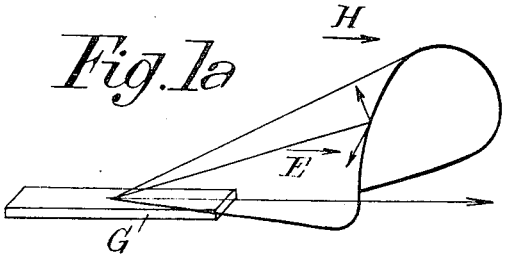
Figure 4:
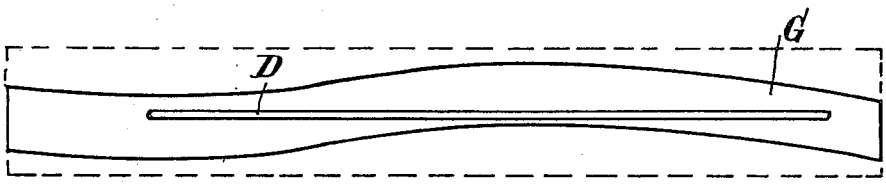
FIG. 4, shows a plane view of the antenna (not to scale) in accordance with this invention.

FIGS. 1 and 4 show a form of an antenna according to the invention. This antenna is a guide (G) with a constant rectangular section, with respect to the rectangular axes Oy, Ox. In one wall of the guide there is a rectangular slit (slot D). The two adjoining walls are incurved with the same sweep of curve, that is to say, the distance between the two walls remains constant.

With the above mentioned definitions, the distance $x$ varies according to the equation:

$$\frac{x}{a} = \frac{x}{a} \frac{(Z)}{(L)}$$

Let E (Z/L) be the desired field illumination of the antenna.

The relative energetic illumination is proportional to the square of this function, i.e.:

$$P\left(\frac{Z}{L}\right) = CE^2\left(\frac{Z}{L}\right) \qquad (1)$$

The normalisation constant C is chosen in such a way that if the feeding energy of the antenna is taken equal to unity and if Wp is the fraction thereof dissipated in the terminal load, their difference WR represents then the total radiated energy:

$$W_R(1) = 1 - Wp(1) = \int_O^1 P\left(\frac{Z}{L}\right) d\left(\frac{Z}{L}\right) = C\int_O^1 E^2\left(\frac{Z}{L}\right) d\left(\frac{Z}{L}\right) \qquad (2)$$

Whereupon, the energetic coupling factor of the slot is determined by the equation:

$$A\left(\frac{Z}{L}\right) = \frac{P\left(\frac{Z}{L}\right)}{1 - \int_O^{\frac{Z}{L}} P(y)\, dy} \qquad (3)$$

In accordance with the invention, the antenna will be assimilated to a hyperfrequency line with losses and the coefficient of the energetic attenuation 2 (Z/L) by the identity:

$$2\alpha \frac{(Z)}{(L)} L = A \frac{(Z)}{(L)}$$

The function A (Z/L) is then correlated with the geometric parameters of the guide, the slot, andof the frequency by the equation already written:

$$A\left(\frac{Z}{L}\right) = K^2 \operatorname{Sin}^2 \pi \frac{x}{a}\left(\frac{Z}{L}\right) \qquad (5)$$

with $$K^2 = \frac{2d}{b} \cdot \frac{\lambda\, \lambda g L}{\lambda_c^3} \qquad (6)$$

Formula (3), taking into account formula (2), is absolutely correct.

Formulas (5) and (6) are the approximations adopted for carrying out the invention. In fact, I have established that for the result aimed at (production of a flat-top radiation pattern in the shape of a half cone with a high efficiency and practically without secondary lobes) proportionality of $$A\left(\frac{Z}{L}\right) \text{ and } \operatorname{Sin}^2 \pi \frac{x}{a}\left(\frac{Z}{L}\right)$$

can be considered as satisfactory, if the distance $x$ from the slot to the middle of the lateral walls of the guide remains less than 0,3 $a$.

The expression $K^2$ given in formula (6) is less correct, but when a certain working wave length is given, the characteristics of the desired radiation diagram define λ, λg, L. The two remaining parameters $d$ and $b$ give great freedom for the eventual readjustment of the numerical value $K^2$.

For an example of a particular reduction to practice of the invention, I had to readjust equation (6) in the following manner:

Assuming that the antenna be field illuminated according to a $\sin^2$ law, with a radiated energy $W_R = 0{,}95$, (supposing 95 % of the incidental power) then with the co-ordinate system adopted:

$$E\left(\frac{Z}{L}\right) = \operatorname{Sin}^2 \pi \frac{Z}{L} \qquad (7)$$

In the latter case, calculation of (2) and (3) supplies with the assumption (5) the following equation which determines the slot:

$$K^2 \operatorname{Sin}^2 \pi \frac{x}{a}\left(\frac{Z}{L}\right) = \frac{2{,}533 \operatorname{Sin}^4 \pi \frac{Z}{L}}{1 - 0{,}95 \frac{Z}{L} + 0{,}302 \operatorname{Sin} \pi \frac{Z}{L} \cos \pi \frac{Z}{L} + 0{,}202 \cdot \operatorname{Sin}^3 \pi \frac{Z}{L} \cos \pi \frac{Z}{L}} \qquad (8)$$

A practical value of $K^2$ is $K^2 = 13$; in these conditions, the maximal value of $x$ is less than 0,3$a$ and corresponds to $Z = 0{,}7$ L Several band X antennas were made with a length of slot varying from 10 to 30 on guides whose ratio b/a changed from 4/9 to ¼ and with maximum radiation angles ψo from 50° to 70° approximately.

The length of the slots was calculated by formula (6), I had to readjust from experience the length of the calculated slot $d$ since I found a maximum difference of ± 25 % between the values of calculated $d$ and experimental $d$.

I established, on this type of antenna, that the presence of the slot introduces phase errors of 2nd and 3rd order, the progressive wave being maintained. In particular, the phase error of the 3rd order has in fact modified by a few degrees the principal direction of the radiation. I found that I might write:

$\operatorname{Sin} \psi 0 = \lambda/\lambda' c$ with $\lambda' c = \sigma \lambda c$ $\sigma$ varying from 0,93 to 0.98 in connection with the various antennas.

Then again, to avoid the introduction of dust or other foreign objects, I have put a film of teflon 0,5 mm deep on the slots, which increased the channel width of the slot by approx. 10 %.

In a practical example, the slot had a length $L = 12\ \lambda$ and was coated with teflon 0,5 mm deep: the width of the slot was $d = 4{,}6$ mm; $\lambda = 2{,}60$ cm. The dimensions of the guide were $a = 16$ mm; $b = 7$ mm. For a special use, the antenna G is shown (FIG. 5) set in a cylinder having a diameter $\phi = 15\ \lambda$. It was found that the principal direction of radiation was $\psi o = 59°$ and that the width of the beam at 3 dB was $\Delta\psi = 8°$, with a level of secondary lobes of about 40 dB.

Figure 2:
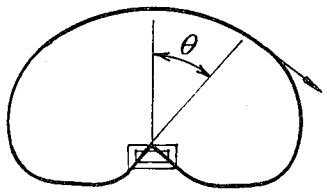
FIG. 2 shows the transversal diagram of radiation for an antenna set in a metallic cylinder.

FIG. 2 gives the transversal diagram of the antenna (3dB width = 180°). If we connect two antennas in parallel and mount them on the previous mentioned cylinder at 180° to one another, the transversal diagram coverage attained is 360° at ± 1 dB approx.

Figure 3:
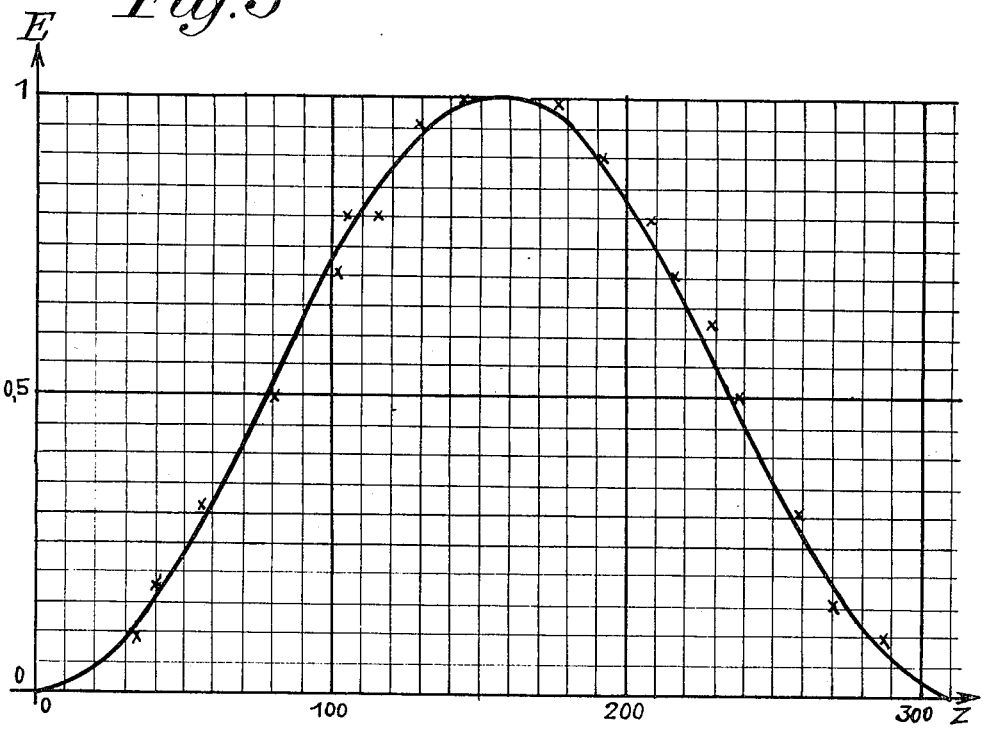
FIG. 3, shows the experimental field data along the slot, for a completed antenna.
Figure 1B:
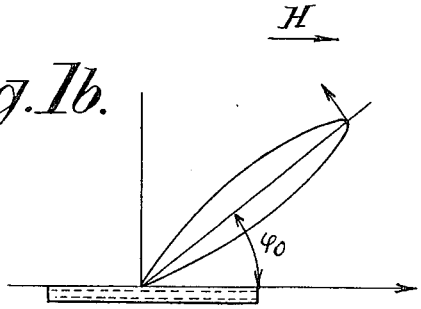

FIG. 3 gives the experimental results of field E along the slot (in relation to Z) and permits an excellent comparison between theory and practice.

Figure 7:
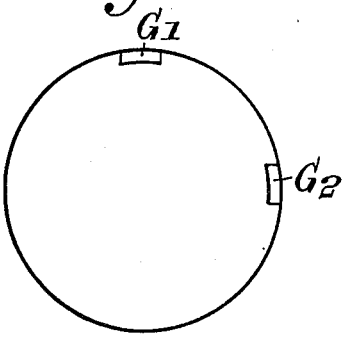
FIG. 7, shows two antennas set in this cylinder at a 90° angle from each other.

When two antennas G1 and G2 are mounted on the cylinder previously mentioned, at 90° from each other, (FIG. 7), G1 is used as a transmission antenna, and G2 as a reception antenna; then an extremely small coupling is established between the two antennas (less than 100 dB). This result is in relation with the very low level of secondary lobes of the antenna.

Figure 6:
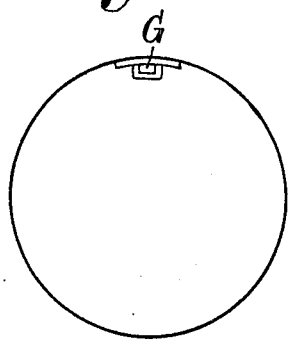
FIG. 6, shows the antenna set in a metallic cylinder.
Figure 5:
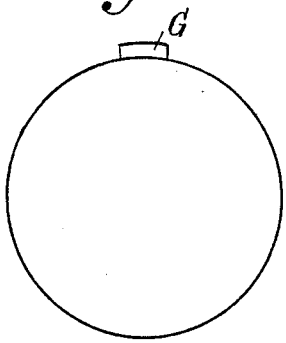
FIG. 5, shows the antenna set on a metallic cylinder.

The antenna could also be mounted on the cylinder as in FIG. 5, which makes the set-up easier, or in the cylinder as shown in FIG. 6. Experiments were made with a cylinder of a diameter $\phi = 10$ and an antenna of length $L = 15$ with a slot width of $d = 3{,}6$ mm with a 0,5 mm coating of teflon ($a = 15$ mm, $b = 6{,}5$ mm). Thanks to the fact that the shape of the slot is strictly rectilinear, whereas the two walls, (that are adjoined to the one with the slot) are incurved in accordance with the mathematical law mentioned herein-above the transversal diagram is stricty symmetrical, (see FIG. 2), and the polarization of the field is perfectly defined.

The wave guide may be made by cutting, folding, and assembling or by machining out of matter. The outer wall in which the slot is executed and the wall parallel thereto may be prolongated and have a straight edge, as shown in FIG. 4 in dotted lines.

What I claim is:

1. Directional antenna for radioelectric waves of a very high frequency, made up of a wave guide section closed at one end by an absorption load, said section comprising a practically plane wall cut with a rectilinear, practically longitudinal radicting slit having a constant width, the two walls adjoining said before mentioned wall being practically perpendicular to the plane of the latter and their distance between them remaining constant along said slit, both said two walls being incurved so that the distance from the slit to each of them varies along the slit.

2. Directional antenna for radioelectric waves of a very high frequency, made up of a wave guide section closed at one end by an absorption load, said section comprising a practically plane wall cut with a practically longitudinal radiating slit having a constant width, the two walls adjoining said before-mentioned wall being practically perpendicular to the plane of the latter and their distance between them remaining constant along said slit, the distance $x$ of the middle of said two walls to the median line of said line varying along said slit as a function of the distance Z from the end of said slit wherefrom the power to be transmitted is fed, which function is:

$$x = \frac{a}{\pi} \text{ arc Sin } \sqrt{\frac{b}{2d} \; \frac{\lambda c^3}{\lambda\, \lambda g L} \; \frac{P\left(\frac{Z}{L}\right)}{1 - \int_o^{\frac{Z}{L}} P(y)\, dy}}$$

in which

- $a$ and $b$ designate the width and the inside height of the aforesaid guide section,
- $d$ designates the width of the slit;
- $\lambda c$ is the cut-off wave length of the aforesaid guide section in the fundamental mode;
- $\lambda$ the length in free space of the waves to be transmitted $\lambda g$ the phase modulated wave length in the transmitting guide section for the wave to be transmitted in the fundamental mode;
- L. the length of the slit;
- P (Z/L) is the relative energetic illumination that has to be obtained at the various points of the slit, this illumination being a function of the aforesaid distance Z divided by the length L;
- Y the variable having a purely mathematical signification, permitting the integration.

3. A continuous slot antenna having an improved radiation patern comprising:

a. a section of rectangular wave guide, b. a long continuous slot cut in one broad face of said wave guide, c. said slot being positioned with respect to the wave guide centerline such that the slot coupling is controlled by varying the distance said slot is offset from said centerline along the length thereof to conform to a predetermined aperture distribution, the power radiated at any point along the slot being determined by the amount of slot offset from the centerline at that point.

* * * * *

UNITED STATES PATENT AND TRADEMARK OFFICE

CERTIFICATE OF CORRECTION

PATENT NO. : 3,978,485

DATED : August 31, 1976

INVENTOR(S) : Pierre BONNAVAL

It is certified that error appears in the above-identified patent and that said Letters Patent are hereby corrected as shown below:

Column 2, lines 19-21, delete "b for the inside height of the guide section for the free space length of the waves which have to be transmitted." and insert -- b for the inside height of the guide section
λ for the free space length of the waves which have to be transmitted. --

Column 2, line 22, change "g" to -- λg --;
line 25, change "c" to -- λc --;
line 26, change "(c = 2a)" to -- (λc = 2a) --;

line 67, change "$\frac{(Z)}{(L)}$" to --$\left(\frac{Z}{L}\right)$--;

Column 3, line 9, change "$\frac{(Z)}{(L)}$" to --$\left(\frac{Z}{L}\right)$--, both occurrences;
line 16, change "WR" to -- $W_R$ --;
line 42, change "2(Z/L)" to -- $2\alpha\left(\frac{Z}{L}\right)$ is bound to $A\left(\frac{Z}{L}\right)$ --;
line 46, change "$A\frac{(Z)}{(L)}$" to -- $A\left(\frac{Z}{L}\right)$ --;
line 50, change "andof" to -- and of --;

Column 5, line 3, change "(FIG. 5)" to -- (FIG. 6) --;
line 46, change "radicting" to -- radiating --;

Column 6, line 29, insert -- τg" insert -- ; --.

Signed and Sealed this

Twenty-second Day of March 1977

[SEAL]

*Attest:*

RUTH C. MASON
*Attesting Officer*

C. MARSHALL DANN
*Commissioner of Patents and Trademarks*